US006800993B2

(12) United States Patent
Tho et al.

(10) Patent No.: US 6,800,993 B2
(45) Date of Patent: Oct. 5, 2004

(54) FLAT CRT PANEL

(75) Inventors: Gi Hoon Tho, Kyongsangbuk-do (KR); Sung Han Jung, Kumi-shi (KR)

(73) Assignee: LG. Philips Displays Korea Co., Ltd., Kyongsangbuk-do (KR)

( * ) Notice: Subject to any disclaimer, the term of this patent is extended or adjusted under 35 U.S.C. 154(b) by 93 days.

(21) Appl. No.: 10/183,505

(22) Filed: Jun. 28, 2002

(65) Prior Publication Data

US 2003/0052589 A1 Mar. 20, 2003

(30) Foreign Application Priority Data

Jul. 24, 2001 (KR) ..... 2001-44557

(51) Int. Cl.[7] ..... H01J 29/89

(52) U.S. Cl. ..... 313/477 R; 313/461; 313/364; 220/2.1 A

(58) Field of Search ..... 313/477 R, 461, 313/364, 478, 479; 220/2.1 A, 2.1 R; 430/26, 27

(56) References Cited

U.S. PATENT DOCUMENTS 4,537,321 A 8/1985 Tokita
6,157,124 A * 12/2000 Wakasono ..... 313/461
6,528,935 B1 * 3/2003 Wakasono et al. ..... 313/461
6,534,907 B1 * 3/2003 Yoshida et al. ..... 313/466
2001/0045796 A1 11/2001 Nah

FOREIGN PATENT DOCUMENTS

EP 1 115 139 A1 7/2001

* cited by examiner

*Primary Examiner*—Edward J. Glick
*Assistant Examiner*—Elizabeth Gemmell
(74) *Attorney, Agent, or Firm*—Birch, Stewart, Kolasch & Birch, LLP

(57) ABSTRACT

Flat CRT panel including a substantially flat outside surface, and an inside surface of a fixed curvature, wherein the inside surface of the panel is formed to meet a condition of {(Rh+Rv)/2}×Rd being in the range of 8.0–10.3, where "Rd" denotes a representative diagonal sectional radius of curvature, "Rh" denotes a representative long-axis sectional radius of curvature, and "Rv" represents a representative short-axis sectional radius of curvature when an effective screen size of the panel is greater than 25", thereby reducing thermal breakage, and permitting fabrication of lighter panel.

7 Claims, 5 Drawing Sheets

FLAT CRT PANEL

This application claims the benefit of the Korean Application No. P2001-44557 filed on Jul. 24, 2001, which is hereby incorporated by reference.

BACKGROUND OF THE INVENTION

1. Field of the Invention

The present invention relates to a flat cathode ray tube (CRT), and more particularly, to a flat CRT panel, which can reduce weight and breakage during heat treatment.

2. Background of the Related Art

Referring to FIG. 1, a structure of a related art color CRT will be explained.

There is a funnel 2 fitted to rear of a panel 1. There is a fluorescent film coated on an inside surface of the panel 1, and there is an electron gun 8 sealed inside of the funnel 2 for emitting an electron beam 11 that makes the fluorescent film on the panel 1 luminescent. There are a deflection yoke 9 and a magnet 10 for deflecting the electron beam 11 to a required path. There are stud pins 6 fitted to the inside of the panel 1 for fastening a main frame 5, to which springs 4 of a shadow mask 3 and an inner shield 7 are fitted.

The operation of the related art color CRT will be explained.

Upon application of a voltage to the electron gun 8, the electron gun 8 emits the electron beam 11. The electron beam 11 emitted thus is deflected in left or right, or up or down direction by the deflection yoke 9, and hits the fluorescent film on inside of the panel 1, according to which a picture is reproduced.

In the meantime, since an inside of the CRT is under substantial high vacuum, such that the panel 1 and the funnel 2 are under a high tension or compression, to be susceptible to implosion caused by an external impact. Consequently, in order to prevent the implosion, the panel 1 is designed to have a certain structural strength, and furthermore, there is a reinforcing band 12 strapped around an outer circumference of skirt of the panel 1, for distribution of stresses on the CRT, thereby securing an impact resistance capability.

In the meantime, referring to FIG. 2A, most of the related art panels are non-flat panels. That is, both an inside surface and an outside surface of the panel have certain curvatures. However, it is current trend that the CRT becomes larger and flat. That is, referring to FIG. 2B, currently a flat panel 1 having almost no curvature on the outside surface is used, mostly.

Though the flat panel 1 has various advantages over the non-flat panel 1*a*, the flat panel 1 has a disadvantage in view of strength. Problems of the related art flat CRT panel will be explained.

First, referring to FIG. 3, the flat panel 1 has a distance from a mold match line to a seal edge line OMH greater than a non-flat panel 1*a*. That is, the flat panel 1 has an overall thickness greater than the non-flat panel 1, to cause breakage due to a high stress exceeding a critical stress coming from a difference of heat conduction during heat treatment of the panel. That is, basically, the flat panel 1 has a structure with a limitation from breakage.

Second, the flat panel 1 is comparatively thick, and heavy, to cost high and require components, such as frame and the like, to be large.

SUMMARY OF THE INVENTION

Accordingly, the present invention is directed to a flat CRT panel that substantially obviates one or more of the problems due to limitations and disadvantages of the related art.

An object of the present invention is to provide a flat CRT panel which can reduce panel breakage during heat treatment (Stabi, Frit Sealing, Evacuation).

Another object of the present invention is to provide a flat CRT panel which can reduce a panel weight and cost.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the flat CRT panel includes a substantially flat outside surface, and an inside surface of a fixed curvature, wherein the inside surface of the panel is formed to meet a condition of $\{(Rh+Rv)/2\}\times Rd=8.0–10.3$, where "Rd" denotes a representative diagonal sectional radius of curvature, "Rh" denotes a representative long-axis sectional radius of curvature, and "Rv" represents a representative short-axis sectional radius of curvature when an effective screen size of the panel is greater than 25".

The panel preferably has a center part thickness greater than or equal to 12.0 mm, and more preferably in a range of 12.0–14.0 mm.

The panel preferably meets a condition of CFT×OAH of being in a range of 1297.10–1454.10, where CFT represents a panel center thickness, and OAH represents a distance from an outside surface of the panel to a seal edge of the skirt, and more preferably in a range of 1338.34–1411.84.

In another aspect of the present invention, there is provided a flat CRT panel including a substantially flat outside surface, and an inside surface of a fixed curvature, wherein a center part thickness of the panel is in a range of 11.9–13.1 if the inside surface of the panel meets a condition of Rh/Rd being in a range of 1.4–1.6, and Rv/Rd being in a range of 0.7–0.8, where "Rd" denotes a representative diagonal sectional radius of curvature, "Rh" denotes a representative long-axis sectional radius of curvature, and "Rv" represents a representative short-axis sectional radius of curvature when an effective screen size of the panel is greater than 29".

The center part thickness of the panel is preferably in a range of 12.1–12.7.

Thus, the flat CRT panel of the present invention can minimize panel breakage in heat treatment, and save a production cost.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
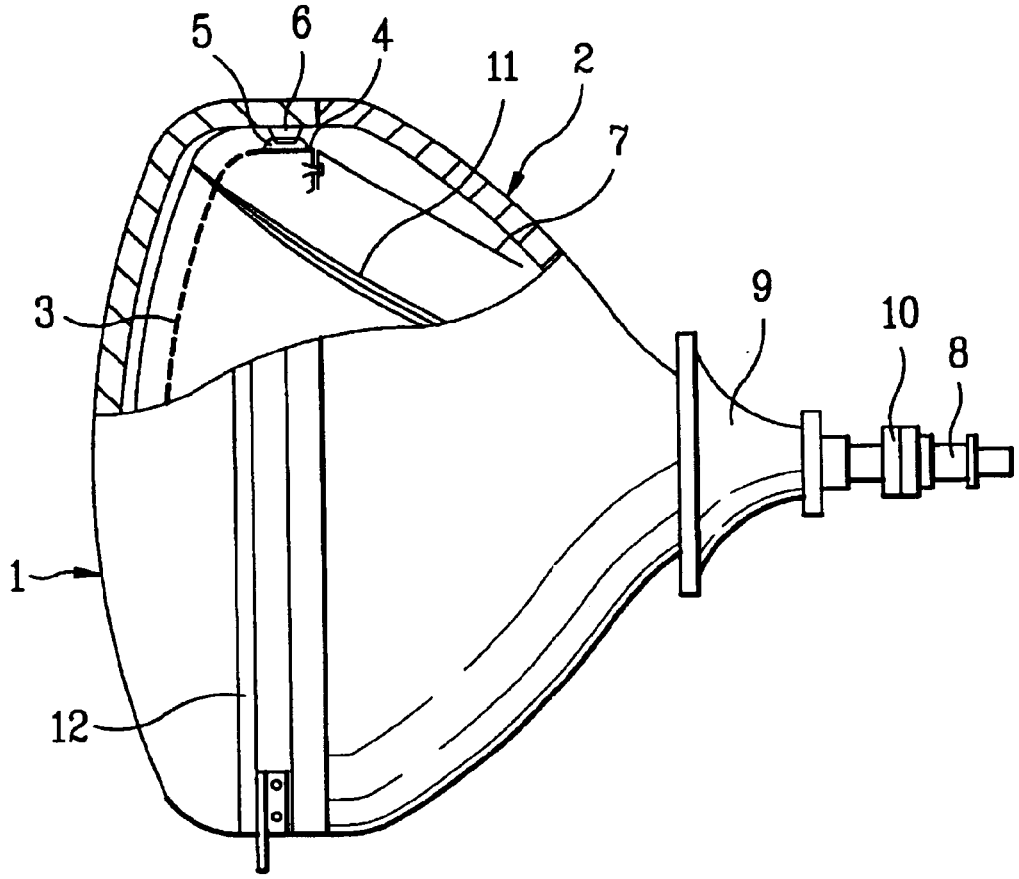
FIG. 1 Related Art
FIG. 1 illustrates a side view of a related art color CRT, with a partial cut away view.
Figure 2A:
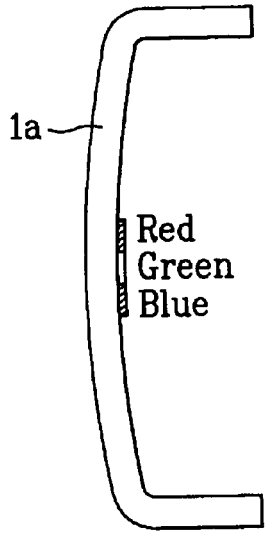
FIG. 2A Related Art
FIG. 2A illustrates a section of a non-flat panel.
Figure 2B:
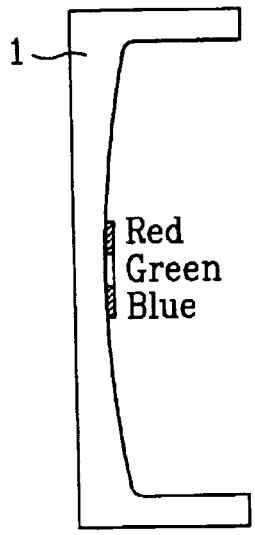
FIG. 2B Related Art
FIG. 2B illustrates a section of a flat panel.

The flat panel in FIG. 2B has a wedge ratio, a ratio of a center thickness of the panel to a thickness of an outermost part of the panel, greater than the non-flat panel shown in FIG. 2A. Particularly, large sized CRTs greater than 29" with the wedge ratio greater than 200% have very high breakage ratio in the heat treatment (hereafter called as a "furnace thermal breakage ratio", or a "broken ratio").

In order to solve this problem, a method may be taken in consideration in which a radius of curvature of an inside surface of the panel may be simply designed greater. However, though the method reduces the wedge ratio, this method has a problem in that a surface strength of the shadow mask, formed in a curvature similar to the inside surface of the panel, becomes weaker. Therefore, it is required to find an optimum panel curvature which can reduce the furnace thermal breakage ratio while the strength of the shadow mask is not reduced.

Figure 4:
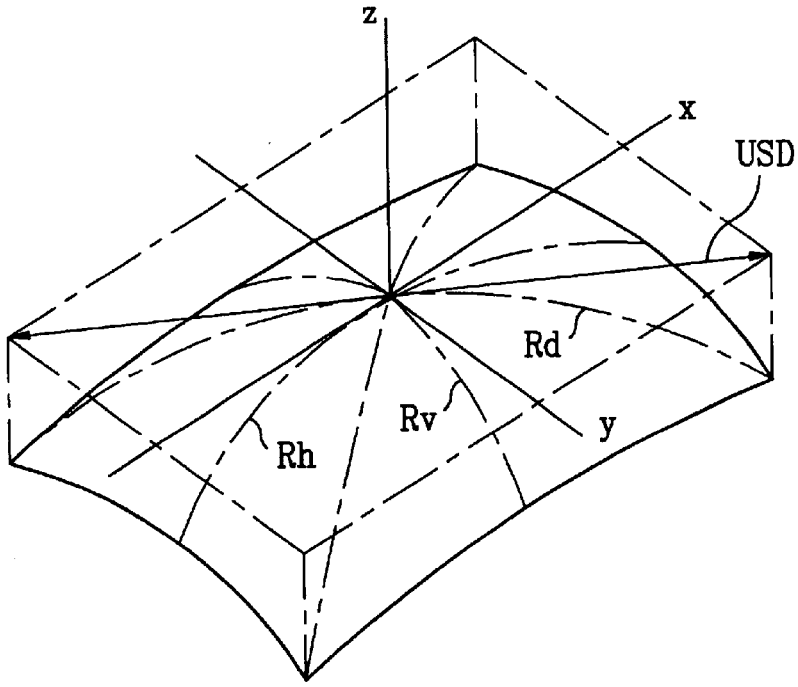
FIG. 4 illustrates a half section of a flat panel with design factors.

Referring to FIG. 4, the panel may be represented with a diagonal sectional radius of curvature 'Rd' passing through a center 'O' of an effective screen on which a picture is displayed, an x-axis sectional radius of curvature Rh passing through the center 'O' of the effective screen in parallel to a long side, and a y-axis sectional radius of curvature Rv passing through the center 'O' of the effective screen in parallel to a short side. Herein, the respective sectional radiuses of curvatures Rd, Rv, and Rh are representative sectional radiuses of curvatures, i.e., respective sectional radiuses of curvatures/(1.767 * a diagonal length of an effective screen (USD)), which will be called as a sectional radius of curvature, simply.

Figure 5:
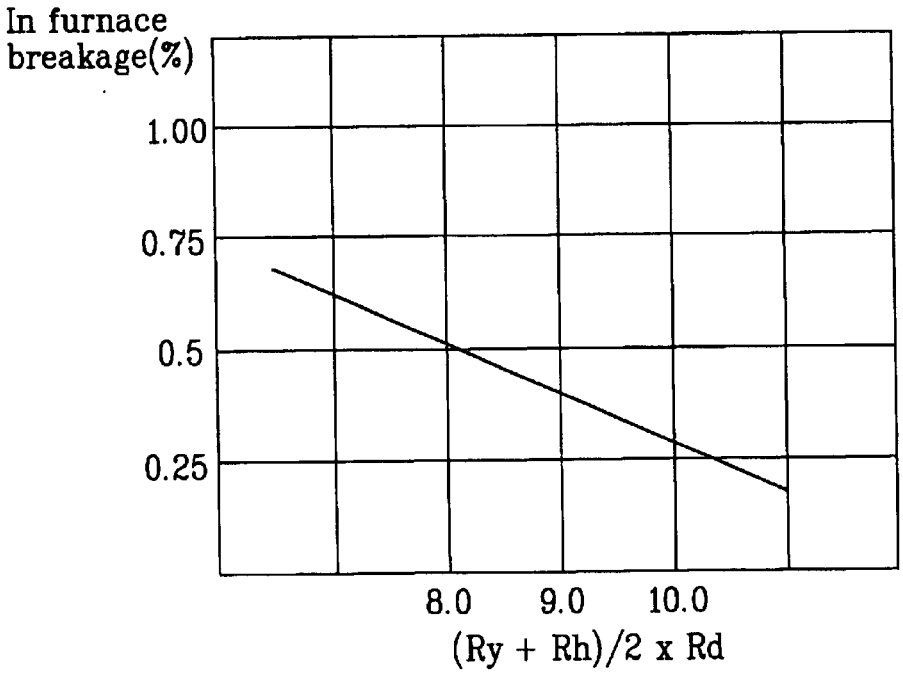
FIG. 5 illustrates a graph showing a curvature of a panel vs. a breakage ratio of the panel in heat treatment.
Figure 6:
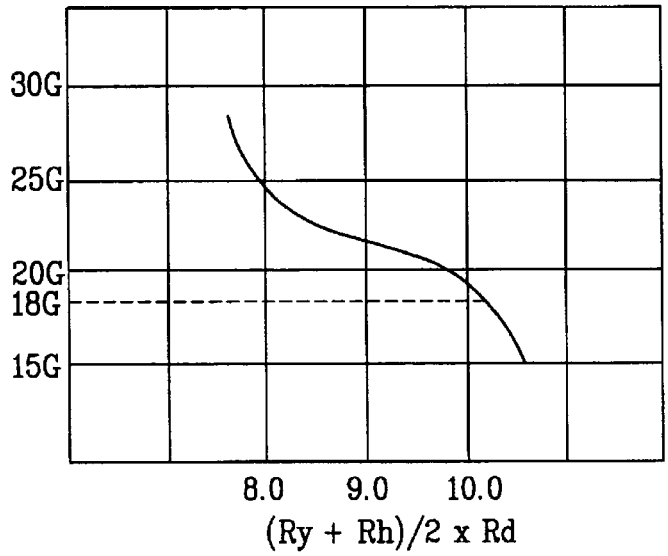
FIG. 6 illustrates a graph showing a curvature of a panel vs. a strength of a shadow mask.

The inventor noted that an optimum panel can be designed by using an expression $\{(Rh+Rv)/2\}\times Rd$, which will be explained. FIGS. 5 and 6 illustrate graphs showing a curvature of a panel represented by an expression $\{(Rh+Rv)/2\}\times Rd$ vs. a furnace thermal breakage ratio of the panel in heat treatment, and a strength of a shadow mask respectively, for a flat panel with a size greater than 25" (590 mm effective screen size) obtained as a result of experiments. However, Braun tubes with sizes below 25" are excluded because the furnace thermal breakage ratio is not too serious and deformation of the shadow mask causes no great problem even if the wedge ratio increases to a certain extent.

First, a relation between $\{(Rh+Rv)/2\}\times Rd$ and the furnace thermal breakage ratio will be explained.

In general, it is preferable that the furnace thermal breakage ratio is managed to be below 0.5%. Therefore, it is preferable that $\{(Rh+Rv)/2\}\times Rd$ is greater than 8.0. Though the related art 29" flat CRT has approx. 1.2–2.0% of the furnace thermal breakage ratio, the same of the present invention is approx. 0.4–1.0%.

Though it appears that a 0.5% of the furnace thermal breakage ratio is little, only a 0.1% reduction of the furnace thermal breakage ratio is substantial in view of improvement of productivity, actually. Because an industry of Braun tube production, being a large scale process industry, has a yearly production of more than one million sets at the greatest, and a few hundreds thousands sets at the smallest, a slight reduction of an overall breakage ratio results in an enormous reduction of a production cost.

Next, a relation between $\{(Rh+Rv)/2\}\times Rd$ and the strength of the shadow mask will be explained.

Drop test is used in testing the strength of the shadow mask. That is, formed shadow masks are dropped at different heights, to see deformations. As can be noted in FIG. 6, for meeting 18G (Gravity), a minimum allowable value for deformation of the shadow mask, it is preferable that $\{(Rh+Rv)/2\}\times Rd$ is below 10.3.

In conclusion, it is preferable that $\{(Rh+Rv)/2\}\times Rd$ of the flat panel is within a range of 8.0–10.3 in view of the furnace thermal breakage ratio and the strength of the shadow mask.

In the meantime, even if the radius of curvature can be fixed from $\{(Rh+Rv)/2\}\times Rd = 8.0–10.3$, it is preferable that a thickness CFT of a center part of the panel is optimized.

Figure 3:
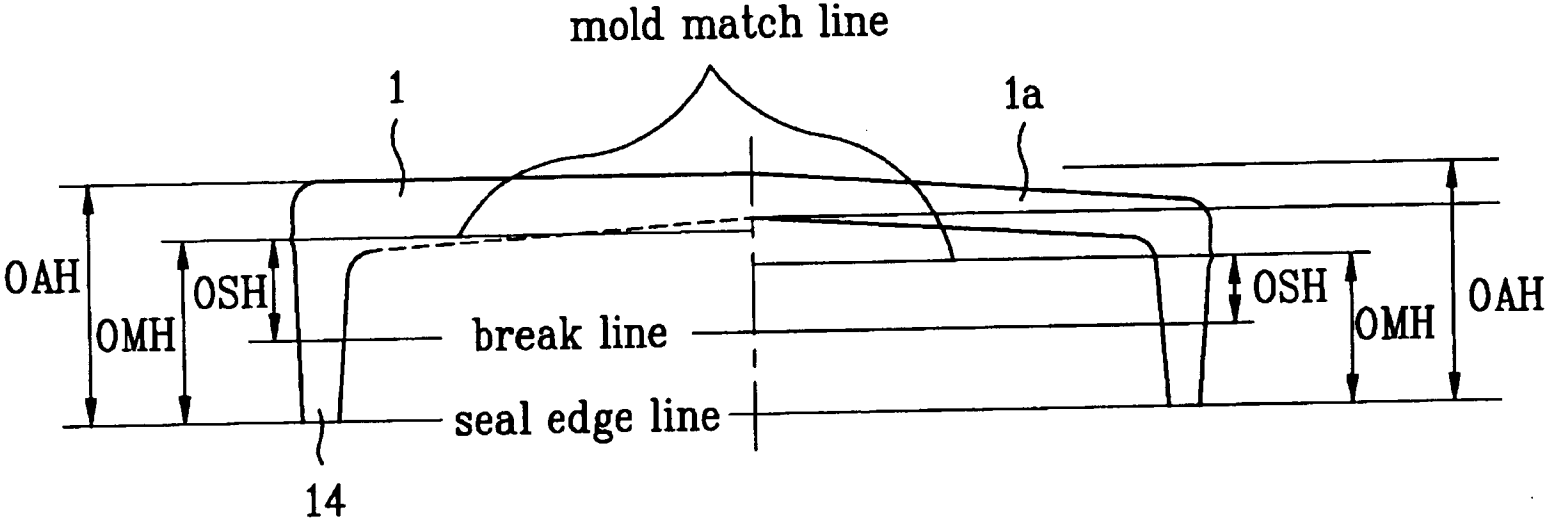
FIG. 3 illustrates half sections of a flat panel and a non-flat panel for comparison.

The thickness CFT of a center part of the panel may be determined in view of an X-ray leakage (see FIG. 3). That is, the thickness CFT of a center part of the panel is determined such that the X-ray leakage is below an allowable value. Because there is an upper limit of the X-ray leakage through the CRT panel fixed by standards for safety, though the X-ray leakage is little. The allowable X-ray leakage is varied with an anode voltage. (For an example, it is required that the X-ray leakage is below 0.5 mR/h at the anode voltage of approx. 41 KV).

Figure 7:
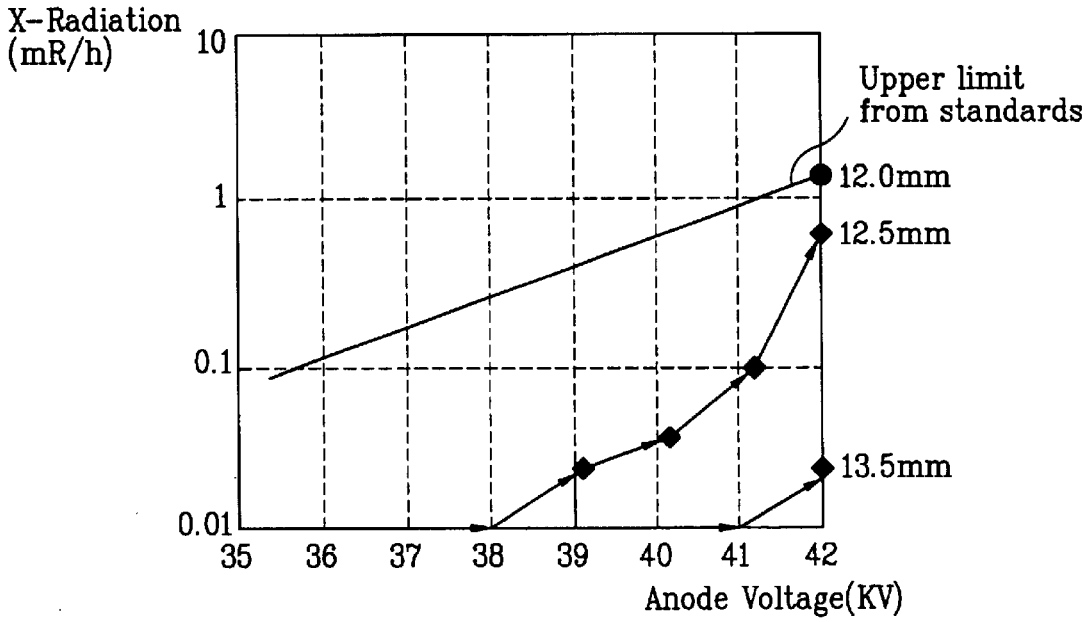
FIG. 7 illustrates a graph showing a panel of the present invention vs. an X-ray leakage.

A relation between the center part thickness of the panel and the X-ray leakage will be explained, with reference to FIG. 7. FIG. 7 illustrates a graph showing the center part thickness CFT of a 29" flat CRT panel with $\{(Rh+Rv)/2\}\times Rd = 8.0–10.3$, more precisely 8.1, and the X-ray leakage. If $\{(Rh+Rv)/2\}\times Rd$ is greater than 10.3, a glass thickness at panel corners is reduced, leading the panel to become more susceptible to the X-ray. If $\{(Rh+Rv)/2\}\times Rd$ is smaller than 8.0, the glass thickness at panel corners is increased, leading the panel unable to endure the furnace thermal breakage.

As can be noted in FIG. 7, if the center part thickness CFT is 12.0 mm, the X-ray leakage reaches to the allowable X-ray leakage. Therefore, according to the present invention, it is required that the center part thickness CFT is greater than or equal to 12.0 mm.

In the meantime, if the center part thickness CFT of the panel is greater than 13.5 mm, the panel is of course safe as the X-ray leakage is below the allowable value. However, a weight reduction in comparison to the related art panel is below 0.5 Kg, and an absolute reduction at the panel corners is little. That is, an effect of weight reduction in view of fabrication of a light weighted panel is little. Therefore, it is preferable that the center thickness CFT of the panel is 12.0–13.5 mm in view of fabrication of a light weighted panel (detailed description of advantages of the present invention in view of fabrication of a light weighted panel will be given later).

On the other hand, the center thickness CFT of the panel may be fixed in view of a vacuum strength of the CRT. As an inside space of the CRT is at a high vacuum, there is a vacuum stress in the panel and the funnel, and it is required that the panel and the funnel are designed to endure the vacuum stress.

The vacuum stress is the highest at a skirt part of the panel and at an end of the effective surface of the panel. Accordingly, the inventor noted that it is preferable that, not only the center part thickness CFT of the panel, but also a distance OAH from an outside surface of the panel to a seal edge part of the skirt, are taken into account.

The following table 1 shows a vacuum stress vs. CFT×OAH of a 29" flat CRT panel with {(Rh+Rv)/2}×Rd =8.0–10.3.

TABLE 1

(stress in Kg/cm²)

| CFT × OAH | | WGT (Kg) | stress 3* | 4* | 5* | 6* | 7* |
|---|---|---|---|---|---|---|---|
| 1624.00 | 1* | 24.71 | 62.07 | 74.48 | 58.03 | 52.27 | 46.82 |
| | 2* | | 53.98 | 81.13 | 67.46 | 65.61 | |
| 1498.50 | 1* | 24.06 | 71.48 | 78.16 | 60.91 | 58.35 | 47.58 |
| | 2* | | 62.65 | 86.94 | 72.16 | 68.49 | |
| 1454.00 | 1* | 23.62 | 73.52 | 79.22 | 61.92 | 58.71 | |
| | 2* | | 66.78 | 88.94 | 73.58 | 69.17 | |
| 1375.00 | 1* | 23.04 | 82.36 | 81.55 | 63.63 | 59.33 | 48.37 |
| | 2* | | 72.60 | 92.80 | 76.96 | 71.42 | |
| 1338.34 | 1* | 23.23 | 86.32 | 85.67 | 65.71 | 59.97 | |
| | 2* | | 80.27 | 98.34 | 80.02 | 73.65 | |
| 1297.10 | 1* | 23.03 | 90.85 | 91.21 | 67.57 | 60.28 | |
| | 2* | | 88.32 | 100.3 | 85.37 | 76.01 | |

1*: long axis direction,
2*: short axis direction,
3*: edge of effective surface,
4*: skirt,
5*: mold match part,
6*: seal edge part,
7*: york part.

In general, it is preferable that the vacuum stress is not over 100 Kg/cm2 with a safety factor 2.4. Therefore, it is preferable that CFT×OAH is greater than 1297.10, and more preferably greater than 1388.34. Moreover, it is preferable that CFT×OAH is below 1454.10, and more preferably below 1411.84 because CFT×OAH over 1454.10 has little effect, with a weight reduction less than 1.0 Kg in comparison to the related art CRT.

In the meantime, the foregoing embodiments are for flat CRT panels with a size greater than 25". The following embodiments are for a 29" flat CRT panel, with an effective screen size of 674–678 mm).

The inventor noted it is preferable that a condition of $1.76 \leqq CFT/676 \times 100 \leqq 1.94$ is met in view of the panel thickness when conditions of $1.4 < Rh/Rd < 1.6$ and $0.7 < Rv/Rd < 0.8$ are met in the 29" CRT. Accordingly, it is preferable that the panel thickness is 11.9–13.1 mm. Because, if the panel thickness is below 11.9 mm like the foregoing embodiment, safety for X-ray can not be assured, and if over 13.1 mm, the weight reduction effect is poor. Moreover, if both the safety for X-ray and the weight reduction are taken into account, it is more preferable that a condition of $1.80 \leqq CFT/676 \times 100 \leqq 1.89$ is met. In detail, the X-ray leakage is dependent on a lead content in the panel and the panel center part thickness CFT. However, since the lead content is regulated in view of environment, the X-ray leakage is actually dependent on the panel center part thickness CFT. Since the 29" flat CRT meets the X-ray leakage limitation when the panel center part thickness CFT is 12.0 mm, it is preferable that the panel center part thickness CFT is a value greater than 12.0 mm, i.e., greater than 12.1 mm.

As has been explained, the present invention can prevent breakage of the panel in the heat treatment, that has been a problem of the related art flat CRT. Moreover, as the present invention can reduce a panel weight, and an absolute height of the panel corner parts, a production cost can be reduced, and a productivity can be improved in comparison to the related art flat CRT panel.

The following table 2 shows weight comparison between the present invention and the related art.

TABLE 2

| | CFT/USD × 100 | | | CFT × OAH | | | WGT |
|---|---|---|---|---|---|---|---|
| | L.L | C.V | U.L | L.L | C.V | U.L | average |
| 1* | 2.06 | 2.14 | 2.23 | 1542.9 | 1624.0 | 1706.3 | 24.71 |
| 2* | 1.76 | 1.85 | 1.94 | 1297.1 | 1375.0 | 1454.1 | 23.40 |

1*: related art panel,
2*: panel of the present invention,
L.L : lower limit,
C.V : center value, and
U.L : upper limit.

Data in table 2 is for a 29" flat CRT panel with {(Rh+Rv)/2}×Rd=8.1. As can be noted in table 2, the panel of the present invention can have reduced weight and thickness in comparison to the related art panel. It can also be noted that, when {(Rh+Rv)/2}×Rd is constant, i.e., even without changing an inside surface curvature of the panel, the panel weight can be reduced. A change of {(Rh+Rv)/2}×Rd implies a change of an inside surface curvature of the panel, and the change of curvature requires re-design of structures to be fitted to the panel. Therefore, change of the {(Rh+Rv)/2}×Rd for the panel weight reduction is actually impossible.

As has been explained, the flat CRT panel of the present invention has the following advantages.

First, a total weight of a flat CRT panel can be reduced by reducing a panel weight, particularly, absolute weight of corner parts in comparison to a related art CRT for CRTs with the same size of the effective screen. Moreover, the improvement of a panel structure, i.e., the reduction of absolute weight of corner parts, with reduced latent heat, prevents occurrence of crack at the corner parts caused by a temperature difference between inside and outside of the panel, effectively. Accordingly, much improvement can be expected for the furnace thermal breakage.

Second, the reduction of required amount of glass in the production of the panel permits to reduce a unit cost of the panel, and the relatively shorter flat panel in comparison to the related art flat panel permits to reduce a total length.

Third, the reduced center part thickness improves a screen luminance, to improve a luminance without affecting a brightness uniformity (B/U).

It will be apparent to those skilled in the art that various modifications and variations can be made in the flat CRT panel of the present invention without departing from the spirit or scope of the invention. Thus, it is intended that the present invention cover the modifications and variations of this invention provided they come within the scope of the appended claims and their equivalents.

What is claimed is:

1. A flat cathode ray tube (CRT) panel comprising:

a substantially flat outside surface; and an inside surface of a fixed curvature, wherein the inside surface of the panel is formed to meet a condition of {(Rh+Rv)/2}×Rd being in the range of 8.0–10.3, where "Rd" denotes a representative diagonal sectional radius of curvature, "Rh" denotes a representative long-axis sectional radius of curvature, and "Rv" represents a representative short-axis sectional radius of curvature when an effective screen size of the panel is greater than 25".

2. A flat CRT panel as claimed in claim 1, wherein the panel has a center part thickness greater than or equal to 12.0 mm.

3. A flat CRT panel as claimed in claim 2, wherein the panel has a center part thickness ranging from 12.0–14.0 mm.

4. A flat CRT panel as claimed in claim 1, wherein the panel meets a condition of CFT×OAH of being in a range of 1297.10–1454.10, where CFT represents a panel center thickness, and OAH represents a distance from an outside surface of the panel to a seal edge of the skirt.

5. A flat CRT panel as claimed in claim 4, wherein the CFT×OAH is in a range of 1338.34–1411.84.

6. A flat CRT panel comprising:

a substantially flat outside surface; and an inside surface of a fixed curvature, wherein a center part thickness of the panel is in a range of 11.9–13.1 if the inside surface of the panel meets a condition of Rh/Rd being in a range of 1.4–1.6, and Rv/Rd being in a range of 0.7–0.8, where "Rd" denotes a representative diagonal sectional radius of curvature, "Rh" denotes a representative long-axis sectional radius of curvature, and "Rv" represents a representative short-axis sectional radius of curvature when an effective screen size of the panel is greater than 29".

7. A flat CRT panel as claimed in claim 6, wherein the center part thickness of the panel is in a range of 12.1–12.7.

* * * * *